US005385485A

United States Patent [19]

Fu

[11] Patent Number: 5,385,485

[45] Date of Patent: Jan. 31, 1995

[54] COPPER SLEEVE FOR LAMP SOCKETS

[76] Inventor: Lin S. Fu, P.O. Box 82-144, Taipei, Taiwan, Prov. of China

[21] Appl. No.: 101,564

[22] Filed: Aug. 3, 1993

[51] Int. Cl.[6] ..... H01R 4/24

[52] U.S. Cl. ..... 439/419; 439/667; 313/318

[58] Field of Search ..... 313/318; 439/414, 419, 439/661, 662, 666, 667, 865, 877

[56] References Cited

U.S. PATENT DOCUMENTS

| | | | |
|---|---|---|---|
| 1,287,542 | 12/1918 | Whitney | 439/414 |
| 1,792,621 | 2/1931 | White | 439/667 X |
| 1,879,768 | 9/1932 | Shalomith | 439/419 |
| 2,172,347 | 9/1939 | Clemence | 439/667 X |
| 2,605,317 | 7/1952 | Tiscione | 439/419 |
| 3,139,315 | 6/1964 | Baldo S. | 439/419 X |
| 3,976,349 | 8/1976 | Kenyon et al. | 439/667 X |

*Primary Examiner*—Khiem Nguyen
*Attorney, Agent, or Firm*—Alfred Lei

[57] ABSTRACT

This invention relates to an improved copper sleeve for lamp sockets and in particular to one including a cylindrical member integrally made of copper, said cylindrical member having a terminal at the lower portion, a slot at the vertical wall, and a hook member at the vertical wall, said terminal being formed with a curved knife point at the lower end, whereby the copper sleeve can be easily fitted in a lamp socket and rapidly connected with a wire.

1 Claim, 4 Drawing Sheets

COPPER SLEEVE FOR LAMP SOCKETS

BACKGROUND OF THE INVENTION

It has been found that the conventional lamp sockets are difficult to be manufactured and assembled. Further, those lamp sockets are not suitable for use with high voltage and easily oxidized thereby rendering them unpractical in use.

Therefore, it is an object of the present invention to provide an improved sleeve for lamp sockets which may obviate and mitigate the above-mentioned drawbacks.

SUMMARY OF THE INVENTION

This invention relates to an improved sleeve for lamp sockets.

It is the primary object of the present invention to provide an improved copper sleeve which can be easily fitted into a lamp socket.

It is another object of the present invention to provide an improved copper sleeve for lamp sockets which can be rapidly connected with the wire.

It is still another object of the present invention to provide an improved copper sleeve for lamp sockets which is facile to manufacture.

It is still another object of the present invention to provide an improved copper sleeve for lamp sockets which is economic to produce.

It is a further object of the present invention to provide an improved copper sleeve for lamp sockets which is simple in construction.

Other objects and merits and a fuller understanding of the present invention will be obtained by those having ordinary skill in the art when the following detailed description of the preferred embodiment is read in conjunction with the accompanying drawings wherein like numerals refer to like or similar parts.

DETAILED DESCRIPTION OF THE PREFERRED EMBODIMENT

Figure 1:
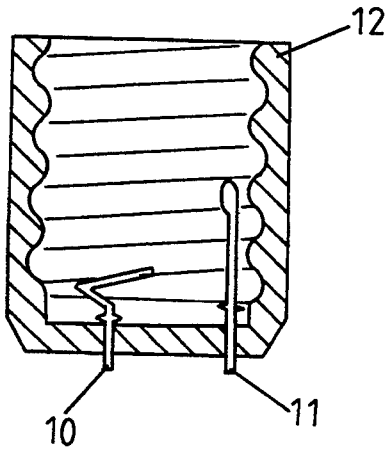
PRIOR ART FIG. 1
FIG. 1 is a sectional view of a prior art socket.

For purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
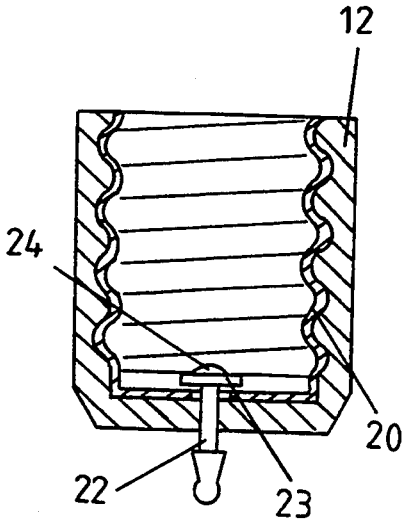
PRIOR ART FIG. 2
FIG. 2 is a sectional view of another prior art socket.

With reference to the drawings and in particular to FIG. 1 thereof, the prior art socket comprises a cylindrical body 12 in which are mounted two copper contacts 10 and 11. FIG. 2 shows a second prior art socket which includes a cylindrical body 12 provided with a terminal 22 having a head 24 separated from the copper member by an insulator 23. However, such two prior art sockets are difficult to be manufactured and assembled. In addition, the two prior art sockets are not suitable for use with high voltage and easily oxidized thereby rendering them unpractical in use.

Figure 3:
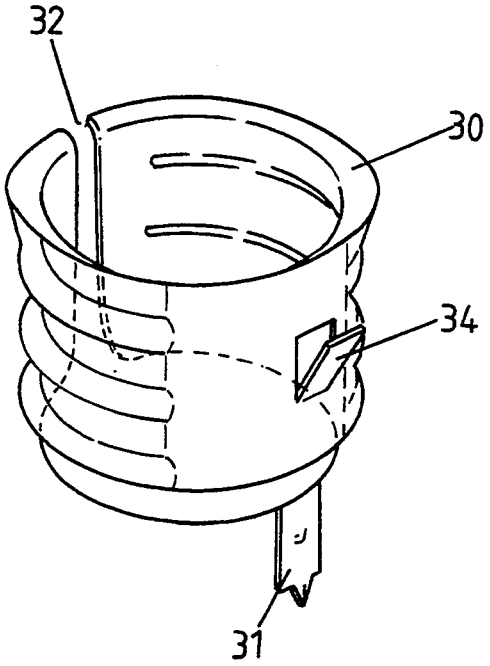
FIG. 3 is a perspective view of a copper sleeve for lamp sockets according to the present invention.
Figure 3A:
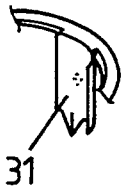
FIG. 3A is an enlarged fragmentary view of the copper sleeve.

Referring to FIGS. 3 and 3A, the copper sleeve according to the present invention comprises a cylindrical member 30 integrally made of copper. The cylindrical member 30 is formed with a terminal 31 having a curved knife point at the lower end. Further, the cylindrical member 30 is formed with a slot 32 so as to make it easier to fit into a light seat (not shown). In addition, the cylindrical member 30 is provided with a hook 34 so that the cylindrical member 30 can be firmly engaged with the light seat 50 (see FIGS. 3 and 5).

Figure 4:
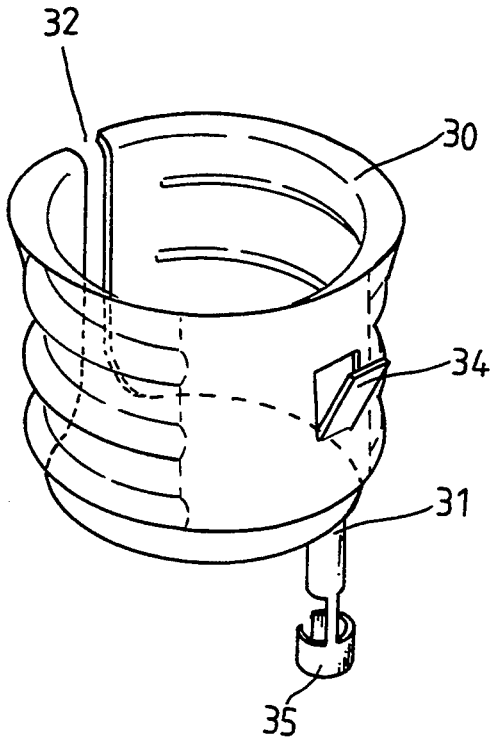
FIG. 4 is a perspective view of a second preferred embodiment of the present invention.
Figure 4A:
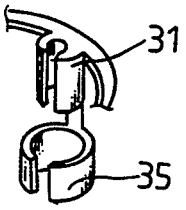
FIG. 4A is an enlarged fragmentary view of the second preferred embodiment.

FIGS. 4 and 4A show another preferred embodiment of the present invention. As illustrated, the terminal 31 is formed with an upper cylindrical clamp 36 for holding the wire (not shown) and a lower cylindrical clamp 35 for holding the protective covering (not shown).

Figure 5:
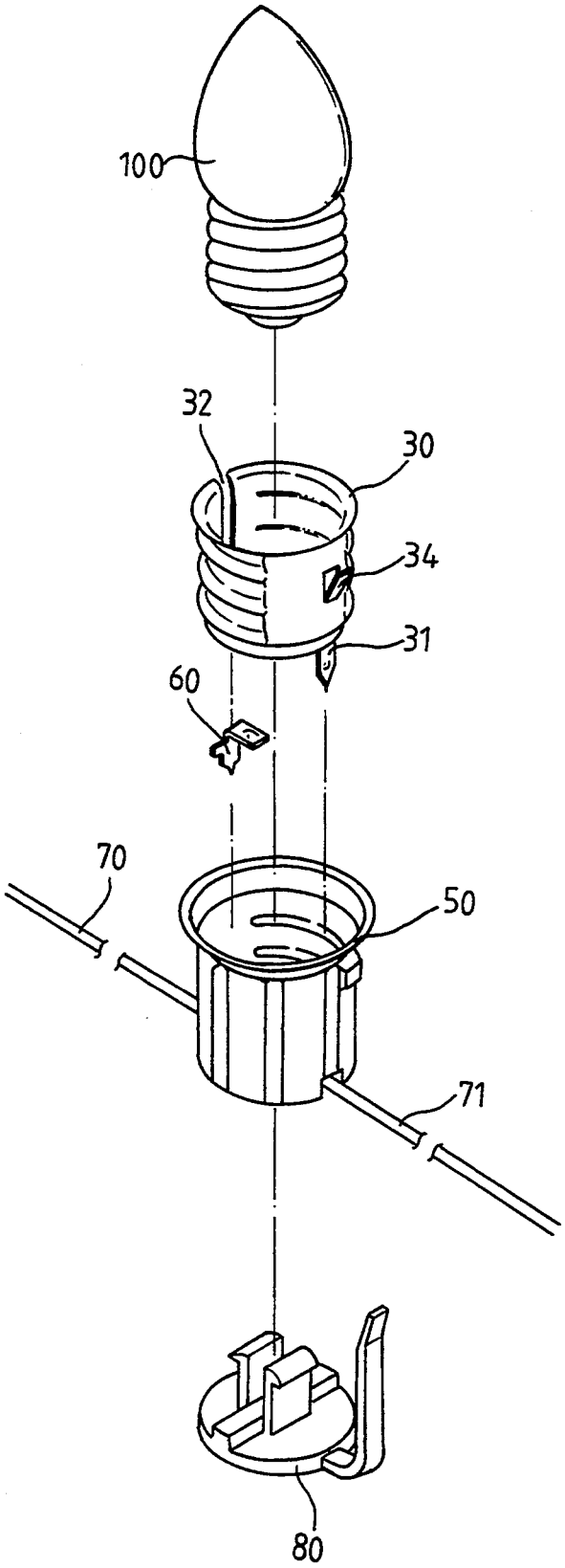
FIG. 5 is a working view of the present invention.

FIG. 5 is a working view of the present invention. As shown, when in assembly, a copper contact 60 is first inserted a light seat 50 and then the cylindrical member 30 is disposed in the light seat 50 so that the copper contact 60 and the terminal 31 are connected with electrical cords 70 and 71 respectively, Thereafter, a base member 80 is mounted on the bottom of the light seat 50 and a light bulb 100 is ready to be turned into the socket 30, The invention is naturally not limited in any sense to the particular features specified in the forgoing or to the details of the particular embodiment which has been chosen in order to illustrate the invention, Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A copper sleeve for a lamp socket comprising a cylindrical member integrally made of copper, said cylindrical member having a lower portion, a vertical wall, a terminal at the lower portion, a longitudinal slot at the vertical wall, and a hook extending upwardly and outwardly from the vertical wall, said terminal being formed with a curved knife point at a lower end.

* * * * *